United States Patent [19]

Spear et al.

[11] 4,143,927

[45] Mar. 13, 1979

[54] CASSETTE LOCKING DEVICE

[75] Inventors: Harry W. Spear, Southborough; Peter J. Coppola, Somerville, both of Mass.

[73] Assignee: Market Forge, a division of Beatrice Foods Co., Everett, Mass.

[21] Appl. No.: 844,270

[22] Filed: Oct. 21, 1977

[51] Int. Cl.[2] ..... A47B 96/06

[52] U.S. Cl. ..... 312/196; 312/196; 312/245; 312/140.4; 248/551; 70/58; 312/140.3

[58] Field of Search ..... 312/196, 245, 237; 248/203; 70/258, 58

[56] References Cited

U.S. PATENT DOCUMENTS

| | | | |
|---|---|---|---|
| 2,306,209 | 12/1942 | Elofson et al. | 312/196 |
| 3,321,165 | 5/1967 | Wann | 248/203 |
| 3,410,122 | 11/1968 | Moses | 248/203 |
| 3,541,256 | 11/1970 | Anders | 312/196 |
| 3,664,616 | 5/1972 | Raskin | 248/203 |
| 3,673,828 | 7/1972 | Jones | 70/58 |
| 3,822,049 | 7/1974 | Saunders | 70/258 |
| 3,850,392 | 11/1974 | Gassaway | 248/203 |
| 3,993,278 | 11/1976 | Race | 70/58 |

*Primary Examiner*—Victor N. Sakran

*Attorney, Agent, or Firm*—Dike, Bronstein, Roberts, Cushman & Pfund

[57] ABSTRACT

The combination with a storage cabinet of a security device for removably locking it to the top of a table or counter to prevent unauthorized removal in the absence of an employee and yet to enable an employee or other authorized person to easily release it for movement from time to time or from place to place as may be expedient. The locking components are designed to be inaccessible from within or without the cabinet.

6 Claims, 10 Drawing Figures

CASSETTE LOCKING DEVICE

BACKGROUND OF THE INVENTION

Devices for securing items such as tape decks, radios, typewriters, television sets and the like to relatively stationary structures are the subject matter of U.S. Pat. Nos. 3,850,392; 3,822,049; 3,664,616; and 3,410,122, each of which comprises a part which is adapted to be bolted or otherwise secured to the relatively stationary structure, for example, the body of a vehicle or office furniture, a part of which is fixed to the item to be secured and locking means so located as to be relatively inaccessible. Such structure generally require fitting or slidingly interengaging parts to each other, a task which is not easy for one person if the item is heavy. The securing device of this invention is designed especially to enable securing medical supply storage cabinets used in hospitals and other institutions so that they cannot be easily removed, so designed as to enable an employee to easily secure and release the storage cabinet when it is deemed expedient to do so for movement from time to time and from place to place without the vexation and delay of having to seek out assistance.

SUMMARY OF THE INVENTION

As herein illustrated, the invention resides in combination with a storage cabinet provided at its bottom at opposite sides with parts extending inwardly from said sides parallel to the bottom, a security device for locking the storage cabinet to a table or countertop, said device comprising a rigid base frame upon which the storage cabinet is adapted to be placed, said frame defining an interior opening beneath the bottom of the cabinet, means extending from the inner side of the frame into the opening beneath the cabinet for receiving fastening means for securing the base frame to the table or countertop, fixed and movable means mounted to the base frame for interengagement with said parts at the bottom of the cabinet, said movable means being movable relative to the fixed means from a position in which said means are at a lesser distance apart than the distance between the parts at the bottom of the cabinet to a position of interengagement with said parts, means for moving the movable parts into locking position and for releasing it therefrom and a key-operated lock for locking and releasing said last means. There is means at the top of the base frame which provides supports for supporting the bottom of the storage cabinet in upwardly spaced parallel relation to the top of the base frame and the parts at the bottom of the storage cabinet and the means at the top of the base frame project into the space between the bottom of the storage cabinet and the top of the base frame. The supporting means at the top of the base frame and the downwardly projecting parts at the bottom of the storage cabinet fill the space between the bottom of the storage cabinet and the base frame, preventing access to the space therebetween. The parts at the bottom of the storage cabinet and the means at the top of the base frame are locking flanges, the former extending inwardly and the latter extending outwardly in overlapping relation. The locking means comprises a bar, to one end of which is fixed the movable locking flange, and there is means supporting the bar for movement longitudinally to move the movable flange relative to the fixed flange, said supporting means comprising bearing means at one side and means slidingly mounting the end of the bar to the bearing means and a lock assembly at the other side of the frame within which said other end of the bar is received and which, by movement, effects movement of the bar in a direction to engage the movable locking flange with the adjacent lock flange at the bottom of the storage cabinet. The lock assembly is adapted to be released by means of a key and there are spring means operable when the lock is released to disengage the movable locking flange from locking engagement with the locking flange at the bottom of the storage cabinet.

Figure 1:
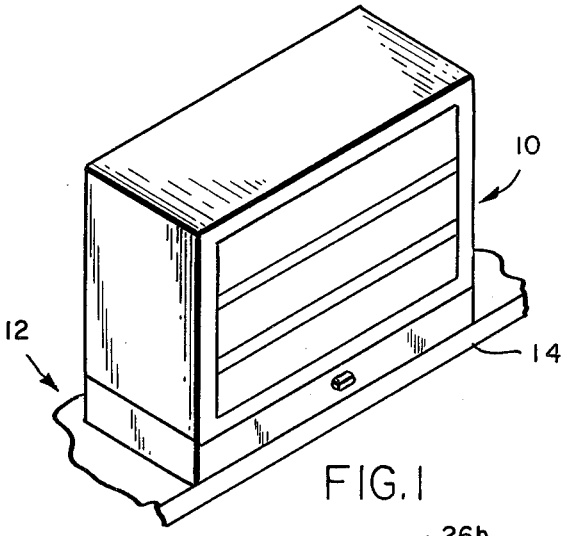
FIG. 1 is a perspective of a storage cabinet and security device for locking it to a table or countertop.
Figure 2:
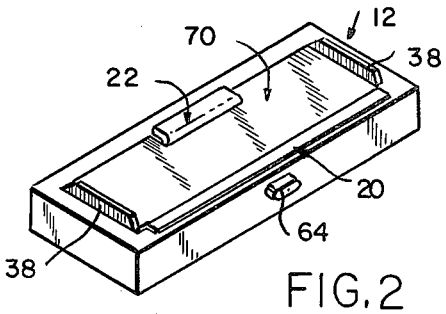
FIG. 2 is a perspective of the security device with the cabinet removed.
Figure 3:
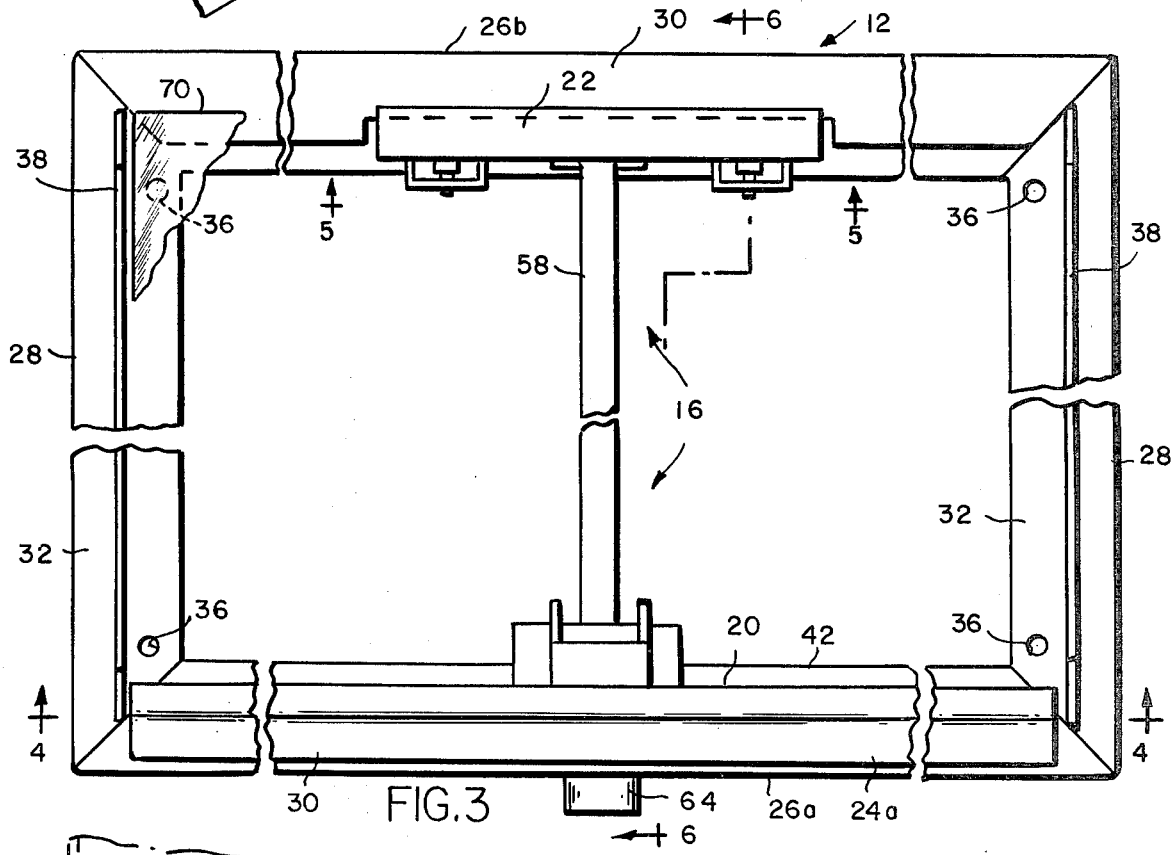
FIG. 3 is a plan view of the security device with the cover plate removed.
Figure 8:
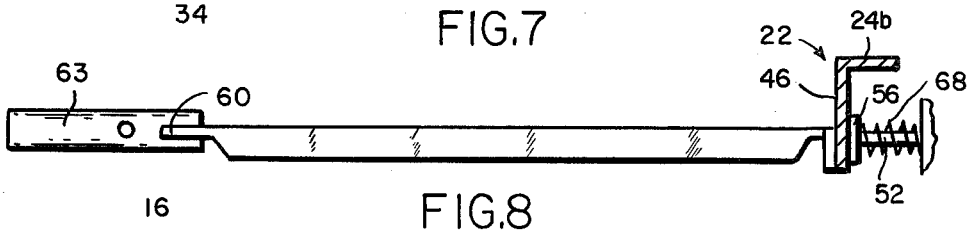
FIG. 8 is an elevation of the locking means removed from the structure.

Referring to the drawings, FIGS. 1 and 2, there is shown a storage cabinet 10 such as might be used in a hospital for the storage of medicants and a security device 12 for fastening the storage cabinet to the top of a table or counter 14 with locking means 16, FIGS. 3 and 8, by means of which the cabinet can be secured and released.

Figure 4:
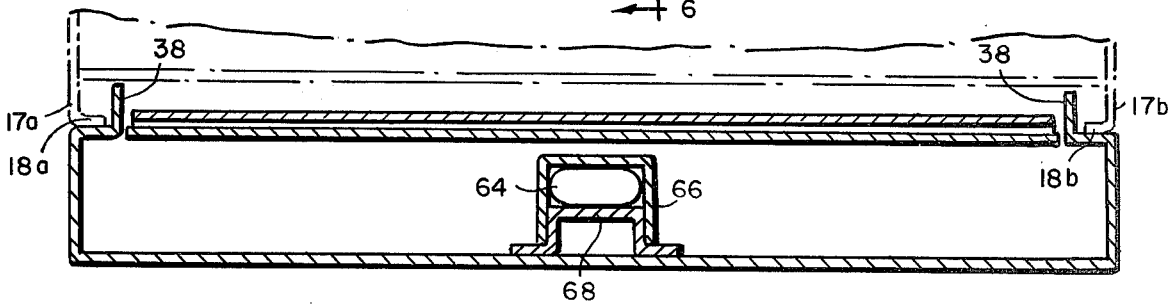
FIG. 4 is a vertical section taken on the line 4—4 of FIG. 3.
Figure 5:
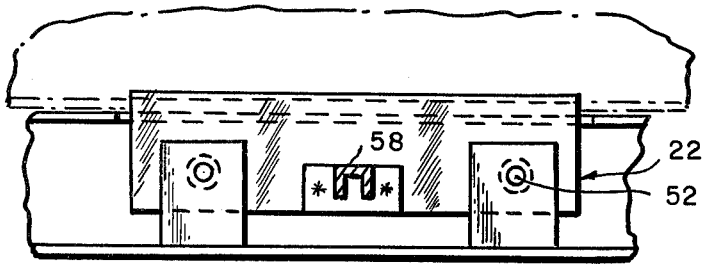
FIG. 5 is a fragmentary elevation taken on the line 5—5 of FIG. 3.

The storage cabinet as shown is of substantially rectangular sheet metal construction and has at two opposite ends or sides integrally formed, downwardly extending angle members $17^a$, $17^b$ FIG. 4 which extend the full length of the sides from which they extend and which have inwardly extending locking flanges $18^a$, $18^b$ spaced from and parallel to the bottom.

Figure 6:
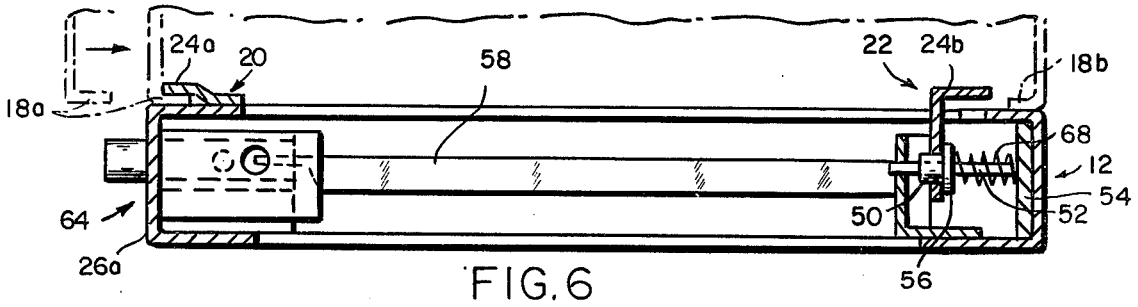
FIG. 6 is a view taken on the line 6—6 showing the locking means disengaged of FIG. 3.
Figure 7:
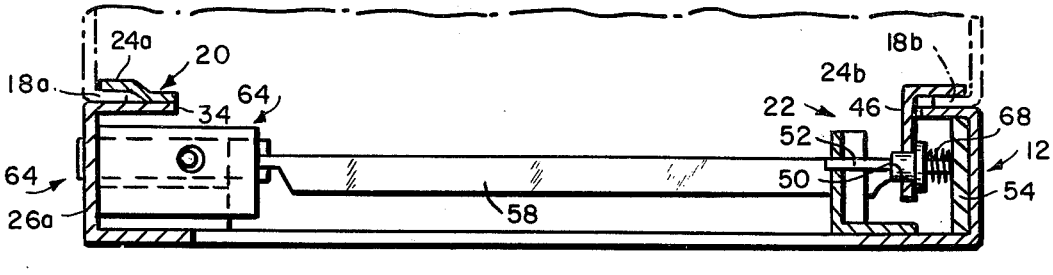
FIG. 7 is a view taken on the line 6—6 of FIG. 3 showing the locking means engaged of FIG. 3.

As illustrated in FIGS. 6 and 7, the security device 12 has stationary and movable angle members 20 and 22 which extend upwardly from the top and have outwardly extending locking flanges $24^a$, $24^b$ for engagement with the locking flanges $18^a$, $18^b$ at the bottom of the cabinet by movement of the movable member 22 relative to the stationary member 20.

Referring to FIG. 3, the security device 12 comprises a rigid base frame having spaced parallel sides $26^a$, $26^b$ and spaced parallel ends 28—28 of sheet metal of generally U-shaped cross section as shown in FIGS. 6 and 7. The side and end members have upper and lower planar surfaces 30—30 along the sides and 32—32 along the ends which define upper and lower openings 34—34. The lower planar portions 32—32 at the ends contain openings 36 for receiving fastening means, for example, bolts or screws, for fastening the base frame to the top of the table or counter. The upper planar members 32—32 at the ends have at their inner edges upstanding, substantially perpendicular flanges 38—38, the upper edges of which are parallel to the said planar surfaces. The upper edges of the upstanding flanges 38—38 are adapted to have engagement with the bottom of the storage cabinet and to hold it supported above the top of the frame in spaced parallel relation thereto FIG. 4.

Along one of the sides $26^a$, there is fixed to the upper planar surface 30, angle member 20, FIGS. 3, 6 and 7 comprising a part 42 welded to the planar surface 30 and an upwardly offset part which constitutes the fixed locking flange $24^a$ spaced from and parallel to the planar surface 30. The angle member 20 extends substantially throughout the entire length of the side $26^a$ to which it is attached.

Figure 9:
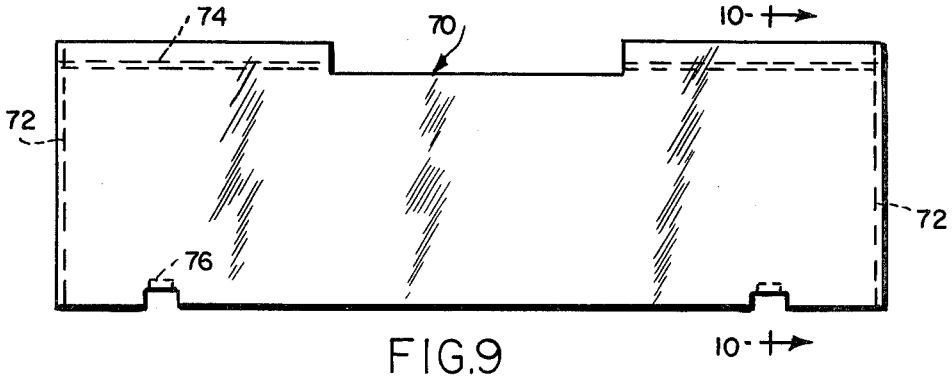
FIG. 9 is a plan view of the cover plate.

At the other side $26^b$ FIG. 9 there is mounted the angle member 22 for movement relative to the fixed locking flange $24^a$ at the one side, comprising a part 46 which is provided with openings 50—50 by means of which it is slidably mounted on spaced parallel pins 52—52. The member 46 is so supported and positioned that the movable locking flange $24^b$ is spaced from and parallel to the top of the frame and is at the same level as the fixed locking flange $24^a$. The pins 52—52 are fixed at one end in a plate 54 welded to the inner side of the side member $26^b$ and supported at their other ends in blocks 56—56 secured by welding to the angle members 22.

A bar 58 FIGS. 3, 6, 7 and 8 is secured at one end to the part 46 substantially midway between the ends and this bar extends transversely of the frame and has at its opposite end a tongue 60 which is engaged within the barrel 63 of a key-operated lock assembly 64. The key-operated lock assembly 64 is mounted to the side $26^a$ by means of upper and lower bracket members 66 and 68 FIG. 4 welded to the inner side of the member $26^a$ between the upper and lower planar portions thereof with a portion of the barrel protruding through an opening in the side wall of the side $26^a$ FIGS. 3 and 6. The lock assembly is of the kind that can be moved to a locking position by applying pressure to its outer end and pushing inwardly and is released by inserting a key. The inward movement of the lock cylinder of the lock assembly effects movement of the bar 58 toward the side $26^b$, thus moving the movable locking flange $24^b$ from a retracted position in which the distance between the locking flanges $24^a$ and $24^b$ is less than the distance between the locking flanges $18^a$, $18^b$ FIG. 6 to a position in which the locking flanges $24^a$ and $24^b$ are engaged with the locking flanges $18^a$, $18^b$ FIG. 7. Coiled springs 68—68 are mounted on the pins 52—52 so that when a key is inserted into the lock assembly to release the lock, the springs will automatically withdraw the locking flange $24^b$ from the locking flange $18^b$.

As thus constructed, when the storage cabinet is placed upon the securing device so as to rest upon the upper edges of the supporting flanges 38—38, the gap between the bottom of the storage cabinet and the securing device is closed at the sides by the vertical portions of the angle members $17^a$, $17^b$, thus making access to the underside of the storage cabinet and/or to the upper side of the locking device impossible.

Figure 10:
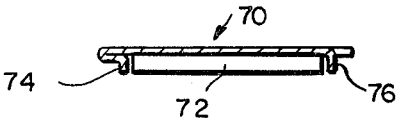
FIG. 10 is a section taken on the line 10—10 of FIG. 9.

A cover plate 70 is provided FIGS. 9 and 10, of rectangular configuration having at its opposite ends right annularly disposed flanges 72—72 and at opposite edges downwardly extending, right angularly disposed tabs 74—74 at one side and 76—76 at the other side. The flanges 72—72 fit between the supporting flanges 38—38, thus preventing endwise movement of the cover plate by abutting engagement with the supporting flanges 38—38, reinforcing and rigidifying said flanges and the tabs 74—74 and 76—76 at opposite longitudinal edges by engagement with the inner side of the sides $26^a$, $26^b$ prevent transverse movement of the cover plate.

The device as thus constructed is designed to enable securing and releasing the cabinet with very little effort and without the aid of tools.

It should be understood that the present disclosure is for the purpose of illustration only and includes all modifications or improvements which fall within the scope of the appended claims.

What is claimed is:

1. In combination with a storage cabinet of predetermined horizontal section provided at its bottom at two opposite sides with flanges extending along the sides and inwardly from the sides, said flanges being spaced downwardly from the bottom and parallel thereto, of a security mount for locking the storage cabinet to a table or countertop, said mount comprising a rigid base frame of corresponding horizontal section having sides coextensive with said two opposite sides of the cabinet, flanges along the two opposite sides of the base extending inwardly therefrom on which the flanges at the bottom of the cabinet are adapted to rest to support the cabinet on the base frame, said flanges on the base frame defining an opening at the top of the base frame beneath the bottom of the cabinet, flanges along the sides and ends of the base frame at the bottom thereof extending inwardly from the sides and ends, said flanges containing holes for receiving fastening means from inside the base frame into the supporting table or counter to bolt the base frame down, locking flanges mounted on the base frame in upwardly-spaced relation to the base flanges, said locking flanges defining along said side horizontal grooves for receiving the flanges at the bottom of the cabinet such that said locking flanges overlie the flanges at the bottom of the cabinet, one of said locking flanges being stationary and the other movable relative to the one to retract it from a locking position overlying the flange at the bottom of the cabinet at that side to a position withdrawn from said overlying position, said movable locking flange being mounted to the base frame on a bar supported transversely of the base frame for movement transversely of the base frame, and a lock mounted to a side of the base frame in a position of alignment with an end of the bar such that movement of the lock to a locking position moves the bar transversely within the base frame which, in turn, moves the movable locking flange into a position overlying the flange at the bottom of the cabinet at that side, said structure being such that all of said flanges are concealed within and between the bottom of the cabinet and the base frame and, hence, are inaccessible to disengagement except by destruction of the cabinet and/or base frame.

2. A combination according to claim 1 wherein there are flanges at the bottom of the cabinet along the other two sides and flanges at the top of the base frame along the other two sides which extend perpendicularly upwardly therefrom into the opening defined by the flanges at the bottom of the cabinet.

3. The combination according to claim 1 wherein a panel is set into the opening in the base frame which prohibits access to the interior of the frame.

4. The combination according to claim 3 wherein said panel is coextensive with the opening of the base frame, two of the ends of the panel abutting the inner sides of said perpendicular flanges and means at the other two sides of the panel extending downwardly therefrom into the opening in the base frame for engagement with the inner edges of the opening.

5. A combination according to claim 1 wherein the lock includes an axially movable barrel within which the end of the bar is received and wherein axial movement of the barrel effects transverse movement of the bar in a direction to effect locking and wherein the lock is key-operated to release the barrel for movement in a direction to permit movement of the locking bar to an unlocking position.

6. A combination according to claim 5 wherein there is spring means yieldably biasing the bar to its unlocking position.

* * * * *